US006739425B1

(12) United States Patent
Griffin et al.

(10) Patent No.: US 6,739,425 B1
(45) Date of Patent: May 25, 2004

(54) EVACUATED ENCLOSURE MOUNTED ACOUSTIC ACTUATOR AND PASSIVE ATTENUATOR

(75) Inventors: Steven Griffin, Albuquerque, NM (US); Benjamin K. Henderson, Albuquerque, NM (US); Joel Gussy, Albuquerque, NM (US); Steven A. Lane, Albuquerque, NM (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 79 days.

(21) Appl. No.: 10/116,892

(22) Filed: Apr. 5, 2002

Related U.S. Application Data

(63) Continuation of application No. 09/618,502, filed on Jul. 18, 2000.

(51) Int. Cl.[7] ..... G10K 13/00; H04R 7/00; H04R 25/00

(52) U.S. Cl. ..... 181/171; 181/172; 381/162; 381/165

(58) Field of Search ..... 181/171, 172, 181/153, 155, 156, 166, 173; 381/386, 392, 395, 423, 431, 203, 202, 205, 193, 162, 165, 166, 59, 96

(56) References Cited

U.S. PATENT DOCUMENTS 2,810,021 A * 10/1957 Brownscombe ..... 381/396
2,846,520 A * 8/1958 Brownscombe ..... 381/430
3,019,849 A * 2/1962 King ..... 181/172
3,573,397 A * 4/1971 Sawyer et al. ..... 381/423
4,284,167 A * 8/1981 Kozlow et al. ..... 181/172
4,607,382 A * 8/1986 Dijkstra et al. ..... 381/392
5,086,473 A * 2/1992 Erath ..... 381/96
5,588,065 A * 12/1996 Tanaka et al. ..... 381/96
5,748,759 A * 5/1998 Croft et al. ..... 381/398
5,771,300 A * 6/1998 Daniels ..... 381/71.5
6,285,773 B1 * 9/2001 Carme et al. ..... 381/418
6,574,346 B1 * 6/2003 Tanaka ..... 381/421

FOREIGN PATENT DOCUMENTS

WO WO 9307729 A1 * 4/1993 ..... H04R/25/00

* cited by examiner

*Primary Examiner*—Rina Duda
*Assistant Examiner*—Edgardo San Martin
(74) *Attorney, Agent, or Firm*—James M. Skorich

(57) ABSTRACT

This invention presents a novel means to passively achieve a compact moving-coil actuator with a very low natural frequency. The diaphragm and voice coil are mounted in a sealed enclosure from which the air is partially or completely evacuated. This reduces the air spring effect. The diaphragm is supported by a non-linear, buckling, or collapsible support apparatus. By taking advantage of the non-linear stiffness properties of such structures, the stiffness of the actuator can be designed to be small at the operating point, which when combined with the moving mass, yields a low natural frequency.

12 Claims, 16 Drawing Sheets

EVACUATED ENCLOSURE MOUNTED ACOUSTIC ACTUATOR AND PASSIVE ATTENUATOR

This is a continuation of application Ser. No. 09/618,502, filed Jul. 18, 2000.

STATEMENT OF GOVERNMENT INTEREST

The conditions under which this invention was made are such as to entitle the Government of the United States under paragraph 1(a) of Executive Order 10096, as represented by the Secretary of the Air Force, to the entire right, title and interest therein, including foreign rights.

BACKGROUND OF THE INVENTION

1. Field of the Invention

This invention is related to the field of acoustic actuators and acoustic control, and in particular, relates to an acoustic actuator mounted in a small sealed enclosure having an extremely low natural frequency.

2. Description of the Prior Art

Often, it is necessary to mount acoustic actuators (such as loudspeakers, i.e., speakers) in relatively small enclosures. This may result from constraints on the space available for mounting or in order for the device to be unobtrusive. However, when a speaker is mounted into a small sealed enclosure, the natural frequency (the fundamental mechanical resonance frequency) is higher than would be exhibited in a large enclosure system due to the air spring effect within the enclosure. This degrades the low frequency performance of the speaker, since speakers radiate sound less effectively below their natural frequency. Consequently, speakers designed for low frequency use are often mounted in very large enclosures. Large volume enclosures have less of an air spring effect, which allows for a lower resonance, improving the speaker's low frequency performance.

If an active feedback circuit is implemented to regulate the motion of the diaphragm, the loudspeaker's natural frequency can be tuned to a specific frequency. Such feedback loops have been widely used to control diaphragm motion and create speaker systems with enhanced low frequency performance (see U.S. Pat. Nos. 5,086,473, and 5,588,065). In addition to audio applications, motion controlled speakers have also been successfully implemented in noise control applications where the low frequency response of the actuator is crucial (U.S. Pat. No. 5,771,300). However, this technique has the disadvantage of requiring active feedback circuitry and additional power sources, and may not be practical to implement.

SUMMARY OF THE INVENTION

The stiffness contribution from the air volume that occurs when mounting acoustic actuators in small sealed enclosures can significantly increase the speaker system's natural frequency. As a result, the actuator is less effective at low frequencies. The present invention is an acoustic actuator mounted in a small sealed enclosure having an extremely low natural frequency. This is accomplished in part by partially or completely evacuating the air from the enclosure to minimize the air spring effect. Additionally, a buckling suspension system is utilized that exhibits a non-linear spring rate. The suspension is capable of supporting the large loads associated with the pressure differential across the diaphragm while simultaneously exhibiting a low stiffness on the order of conventional speaker suspensions. The present invention enables the construction of small-enclosure-mounted sub-woofers that perform as well or better than similar large-enclosure-mounted sub-woofers. It is also applicable to noise control systems where low frequency response is critical, e.g., small-volume passive acoustic attenuators for damping acoustic modes in rooms.

BRIEF DESCRIPTION OF THE DRAWINGS

The various features of novelty that characterize the invention are pointed out with particularity in the claims annexed to and forming a part of this disclosure. For a better understanding of the invention, its operating advantages, and specific objects attained by its uses, reference is made to the accompanying drawings and descriptive matter in which a preferred embodiment of the invention is illustrated.

DESCRIPTION OF THE PREFERRED EMBODIMENT

Figure 1:
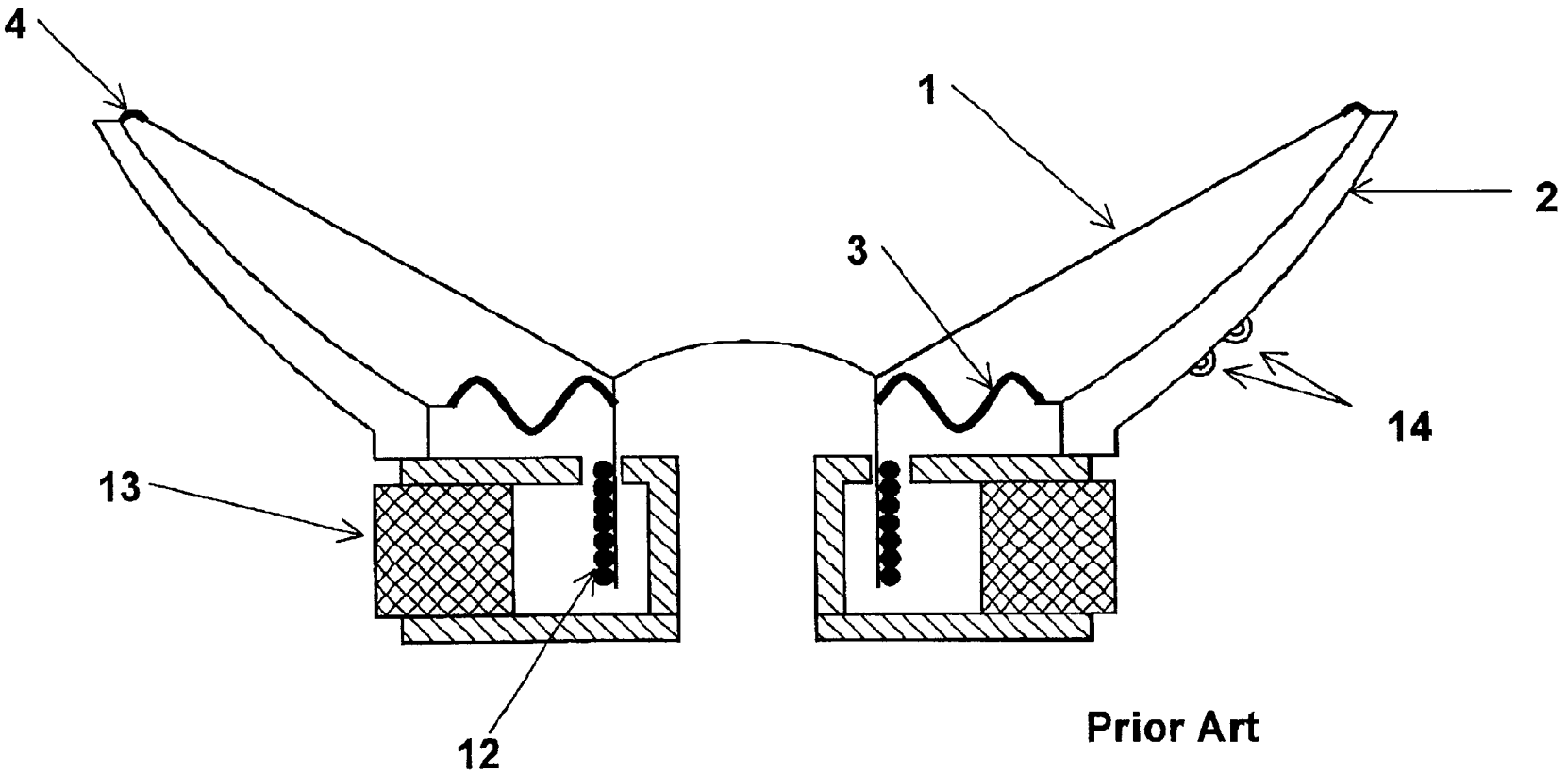
Prior Art FIG. 1
FIG. 1 is a schematic diagram of a typical moving-coil acoustic actuator.
Figure 2:
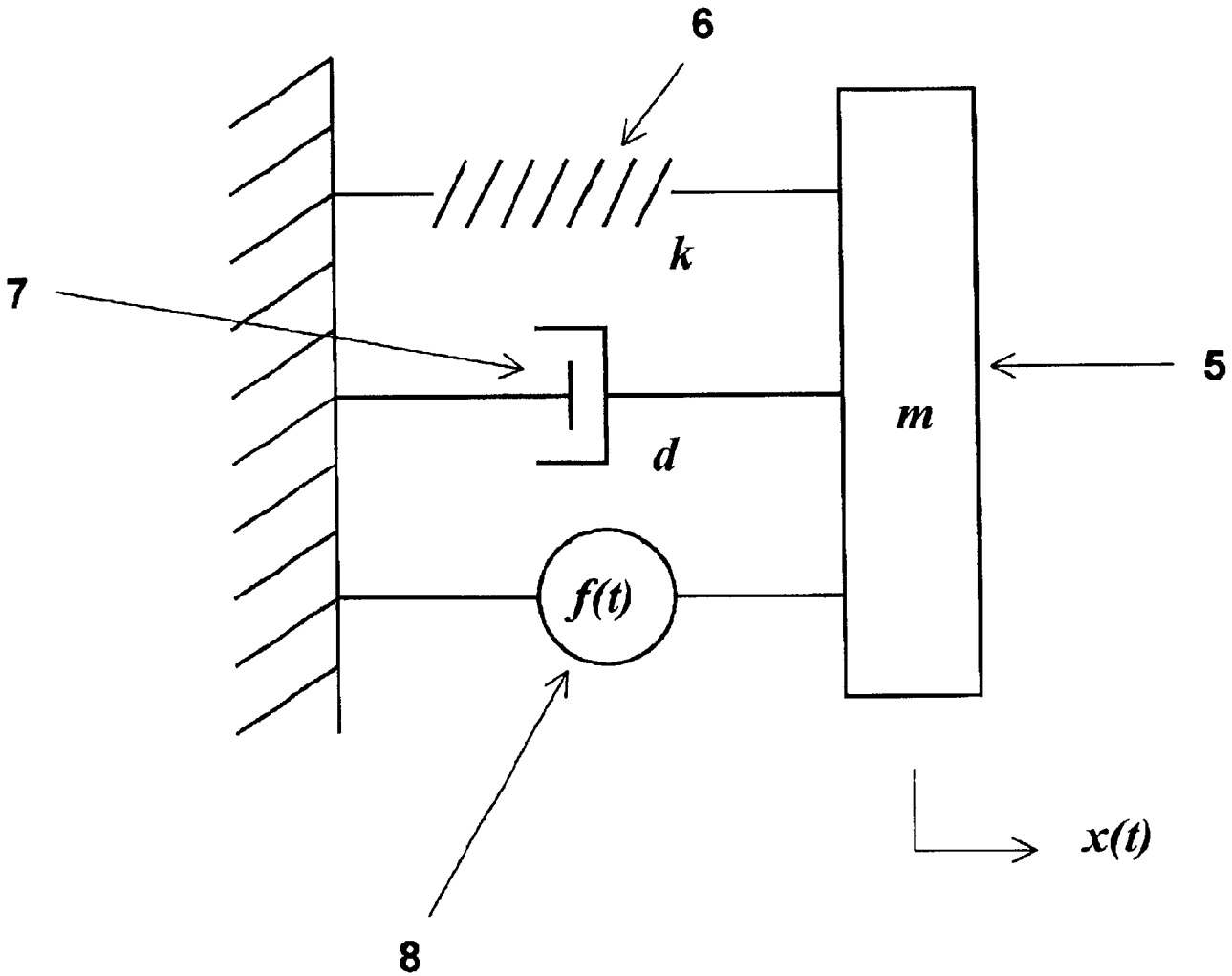
FIG. 2 is a mass-spring-damper model of the low frequency dynamics of a moving-coil acoustic actuator.
Figure 3:
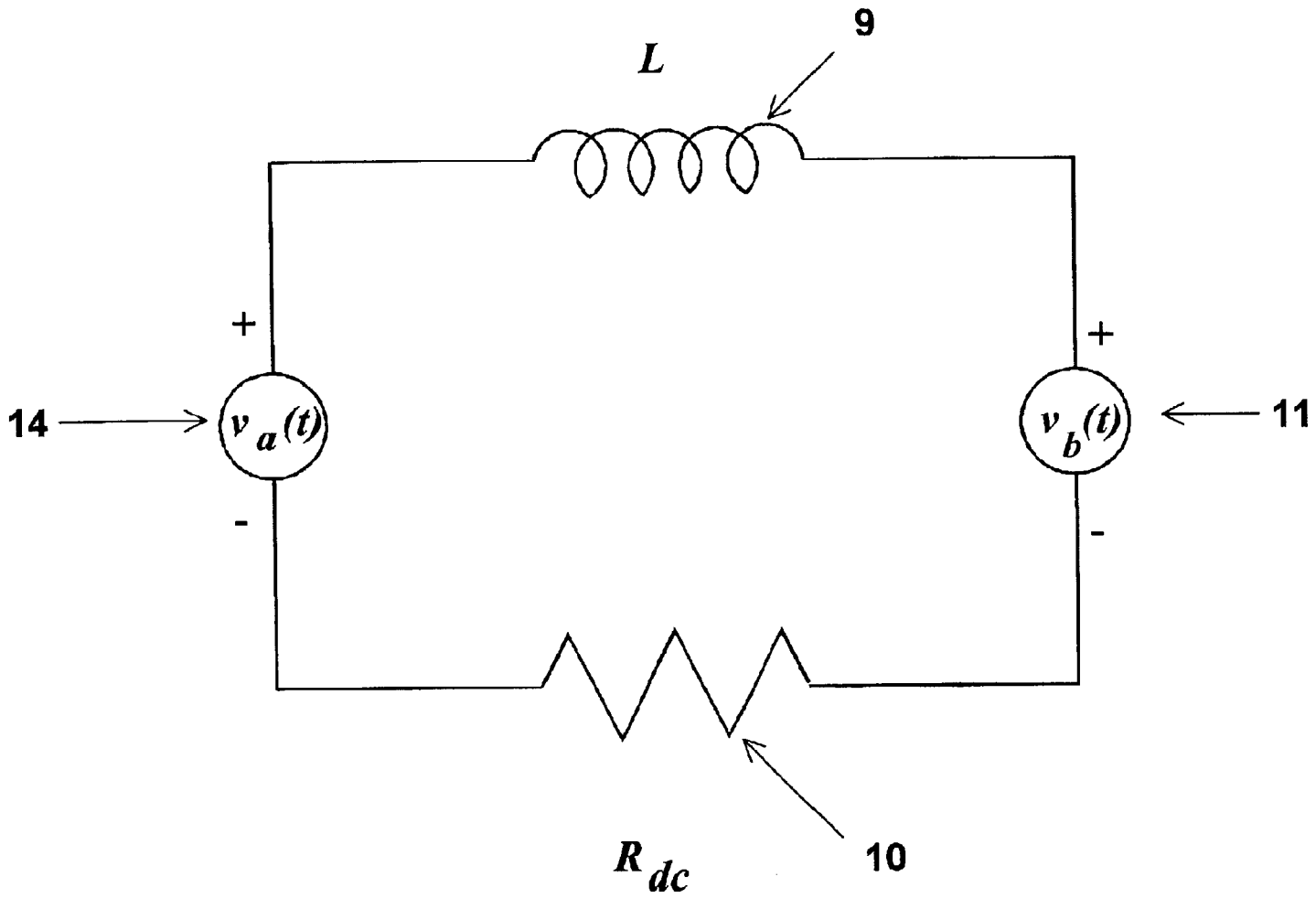
FIG. 3 is a model of the low frequency electrical dynamics of a moving-coil acoustic actuator.

A schematic diagram of a typical moving-coil loudspeaker is presented in FIG. 1. The diaphragm 1 is attached to the frame 2 by the spider 3 and the surround 4, both of which provide compliance (the inverse of stiffness) and damping to the loudspeaker system. Other elements include a voice coil 12, permanent magnets 13, and terminal inputs 14. At low frequency, the speaker responds as a simple mass-spring-damper system. It can be modeled as shown in FIG. 2 using a mass element 5 representing the moving mass of the system, a spring element 6, a damper element 7 representing the stiffness and damping of the speaker suspension, respectively, and an electromechanical force input 8. The electrical dynamics of the loudspeaker can be modeled as shown in FIG. 3 by an inductor 9, a resistor 10, and a controlled voltage source, 11. The inductance effect results from the voice coil 12 (FIG. 1), and the resistor models the DC coil resistance. The voice coil is positioned in a magnetic field created by a permanent magnet 13 (FIG. 1). A voltage, $v_a(t)$, applied across the speaker input terminals 14, pushes current through the voice coil 12. The passage of current through the coil wire creates the driving force that moves the attached diaphragm and generates the acoustic pressure response. The movement of the voice coil within the magnetic field induces the flow of current in the opposite direction, which creates a back EMF (electromotive force), modeled here as an AC voltage source 11. The back EMF, $v_b(t)$, is proportional to the diaphragm velocity, $\dot{x}(t)$, by the actuator constant $\psi$.

Using Newton's second law of motion, the mechanical dynamics can be modeled by a second-order differential equation, given as:

$$m\ddot{x}(t)+d\dot{x}(t)+kx(t)=\psi i(t), \tag{1}$$

where i(t) is the driving current, x(t) is the diaphragm displacement, m is the moving mass 5, d is the system damping 7, and k is the stiffness 6 (FIG. 2). The electrical dynamics can be modeled by a first-order differential equation using Kirchoff's voltage law:

$$L\frac{di(t)}{dt}+R_{dc}i(t)+\psi\dot{x}(t)=v_a(t), \tag{2}$$

where L is the coil inductance 9, $R_{dc}$ is the DC coil resistance 10, and $v_a(t)$ is the voltage applied to the terminals 14.

For a speaker mounted in an infinite baffle and radiating into free-space, the magnitude of the pressure response 1-meter directly in front of the speaker is given by $$\text{pressure amplitude at 1 meter}=2\rho_o C|\dot{x}(t)|\left|\sin\left\{\frac{1}{2}\frac{\omega}{c}\left[\sqrt{1+a^2}-1\right]\right\}\right|, \tag{3}$$

where $\rho_o$ is the air density, c is the sound speed, $\dot{x}(t)$ is the diaphragm velocity, $\omega$ is the frequency of oscillation of the diaphragm, and a is the diaphragm radius (Kinsler, Lawrence E., Frey, Austin, R. et al., *Fundamentals of Acoustics*, 3rd edition, John Wiley and Sons, New York, 1982). This can be used as a reasonable approximation of the pressure radiated from a speaker mounted in a sealed enclosure as a function of the applied voltage.

For a speaker mounted in a sealed enclosure, the air in the enclosure behaves as a spring when compressed or rarefied by the movement of the diaphragm, which is referred to as the air spring effect. The equivalent stiffness of the air spring, $k_S$, can be approximated by $$k_s=\frac{\rho_e c^2 S}{V}, \tag{4}$$

where S is the surface area of the diaphragm, $\rho_e$ is the density of the air in the enclosure, c is the sound speed, and V is the volume of the enclosure. If the enclosure is small, the stiffness of the air spring may be larger than the stiffness of the speaker's suspension, and will significantly impact the speaker's resonance frequency and response.

The present invention reduces or eliminates the air spring effect by evacuating the enclosure. Using the ideal gas law and assuming that the system is isothermal, the density of the air in the enclosure is directly proportional to the absolute pressure in the enclosure. Therefore, a reduction in the internal pressure of the enclosure translates to a reduction in the stiffness of the air spring.

Figure 4:
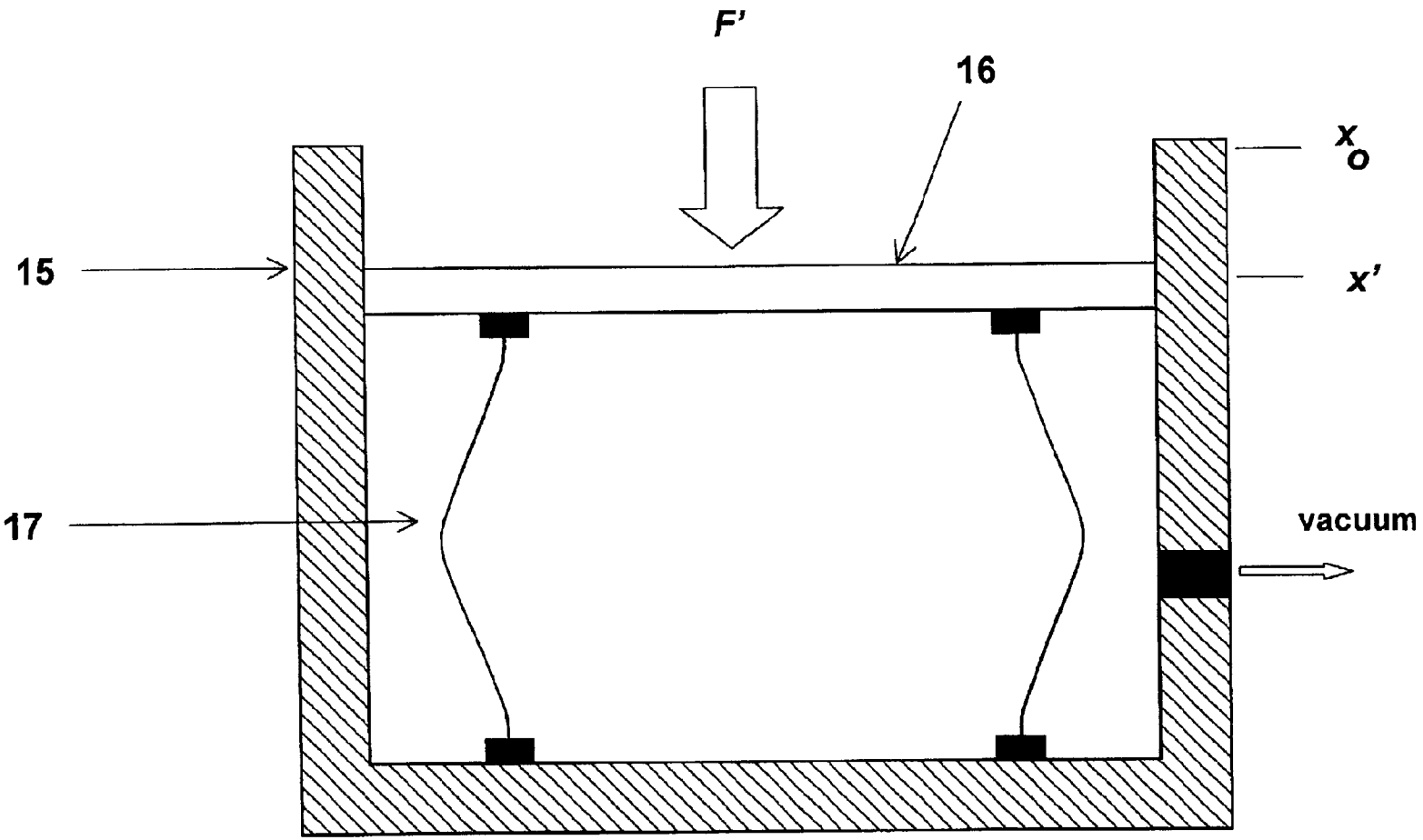
FIG. 4 illustrates the buckling support apparatus utilized by the invention.

As illustrated in FIG. 4, evacuating the air in the speaker enclosure 15, will pull the diaphragm 16 inwards because of the external and internal pressure difference. The force acting on the diaphragm is the product of the pressure difference and the diaphragm surface area, which may far exceed the capacity of the speaker suspension. Furthermore, the pressure will likely cause significant deformation or even failure of the diaphragm itself. Thus, it is required to use a more rigid diaphragm and a different approach to suspending the diaphragm. This invention proposes to use a stiff diaphragm and a collapsible or buckling support apparatus 17 to attach the diaphragm to the enclosure. A stiff metal or composite support and diaphragm will prevent implosion of the diaphragm under large pressure loads.

Figure 5:
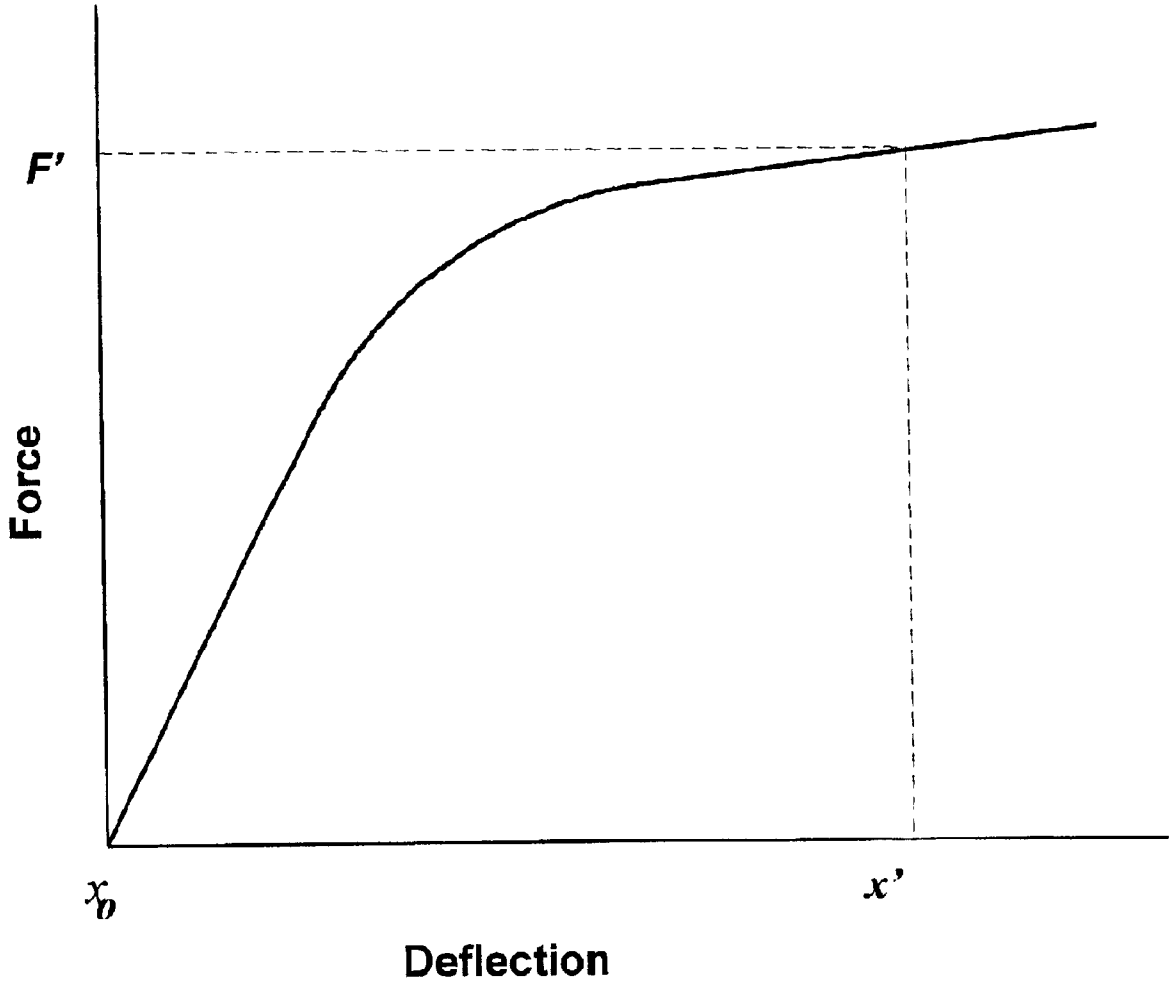
FIG. 5 shows a typical force versus deflection curve for a buckling slender bean.

In addition, another advantage is realized using a collapsible support. From analysis of buckling beams and elastic deformations, it is known that as the support buckles, the effective stiffness of the support changes (Simitses, George J., *An Introduction to the Elastic Stability of Structures*, Robert E. Krieger Publishing Company, Malabar, Fla., 1976; Den Hartog, J. P., *Strength of Materials*, McGraw-Hill Book Company, New York, 1949). FIG. 5 presents a representative force versus deflection curve for a slender beam. As the loading force from the pressure differential increases to the desired load value, indicated as F' in FIG. 4 and FIG. 5, the diaphragm deflects from its initial position, $x_o$, to the desired operating point, x'. The slope of the curve shown in FIG. 5 represents the spring-constant, or stiffness, of the beam or support member. Notice that as the deflection increases, the slope of the curve, and hence the stiffness, decreases. This curve is valid as long as the material is not stressed beyond its elastic stress limit. By careful design of the support apparatus, the stiffness can be made to approach zero at the operating point. This yields a system with very low stiffness contribution from the supporting apparatus, and virtually no air spring. Since the original suspension is replaced by the collapsible suspension, the damping of the suspension can be optimized by the designer to achieve the desired performance.

Figure 6:
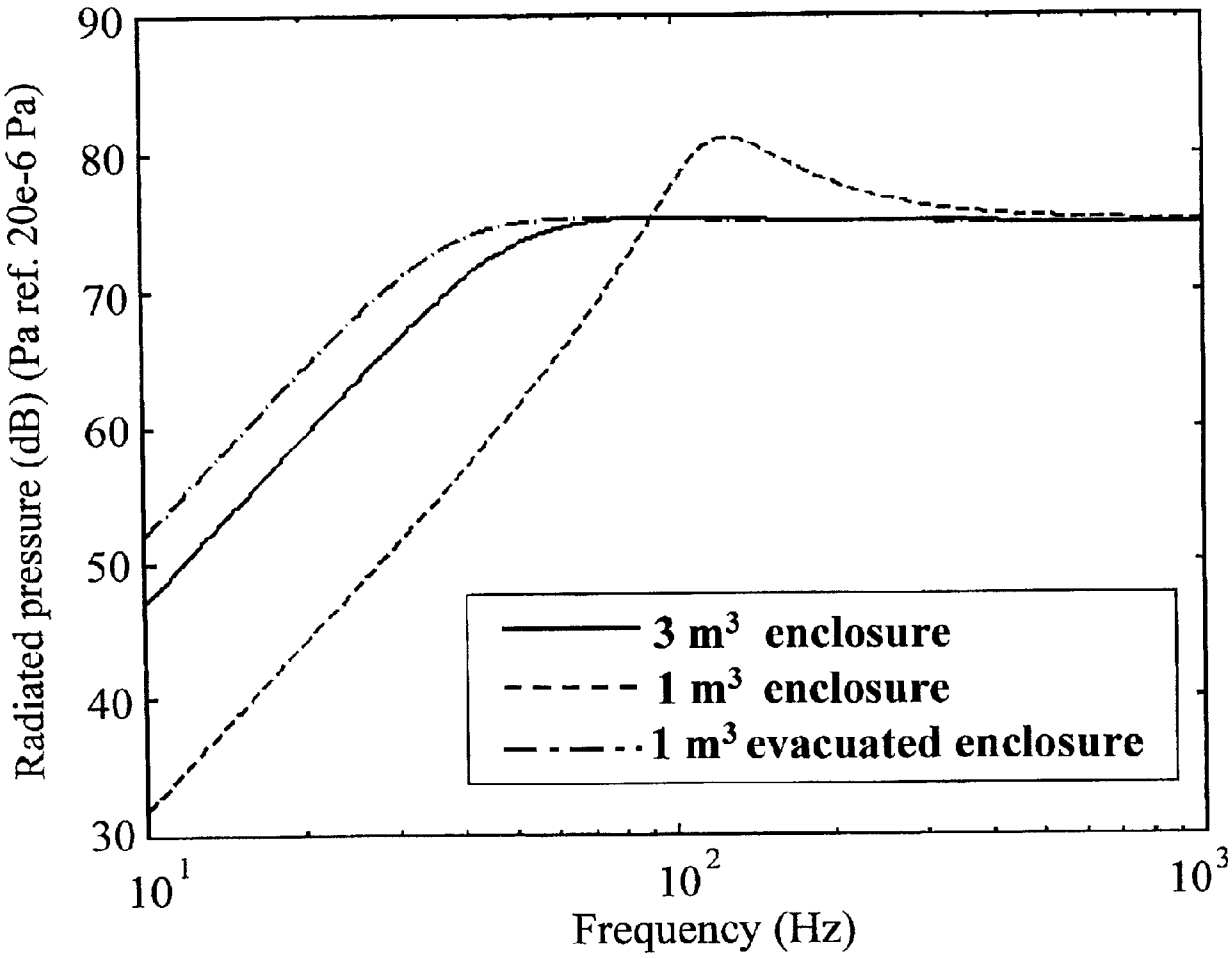
FIG. 6 is a simulation of the on-axis radiated pressure response for an enclosure mounted loudspeaker using a large volume enclosure, a small volume enclosure, and a small volume evacuated enclosure.

A numerical simulation is given to illustrate this concept. Consider a typical off-the-shelf loudspeaker with parameters given in Table 1. Using Equations (1) to (3), the pressure response of the speaker when mounted in a large (1 $m^3$) rectangular enclosure was computed and is shown in FIG. 6. The response of the same speaker mounted in a small cylindrical enclosure with dimensions listed in Table 1 is also presented in FIG. 6. The resonance frequency increases from 50 Hz to approximately 120 Hz as a result of the increased stiffness of the smaller enclosure. The speaker is less effective at low frequencies as indicated by the roll-off below the resonance frequency.

TABLE 1

| | Value |
|---|---|
| Loudspeaker parameters used in the simulations: | |
| Moving mass, m | 0.05 (kg) |
| Inductance, L | 20 mH |
| Stiffness, k | 3.2 (kN/m) |
| DC coil resistance, $R_{dc}$ | 4.7 Ω |

TABLE 1-continued

| | Value |
|---|---|
| Damping constant, d | 7.5 (N · s/m) |
| Free air resonance, $f_s$ | 40 Hz |
| Force constant, ψ | 6.7 (N/A) |
| Diaphragm radius, a | 10 cm |
| Cylindrical enclosure parameters: | |
| Inner radius | 12.7 cm |
| Height | 12.7 cm |
| Volume | 0.006 $m^3$ |

Now assume that the enclosure is evacuated such that the internal pressure is one-tenth of the external pressure, and the stiffness of the buckled support at the operating point is approximately one-tenth that of the off-the-shelf speaker. It is also assumed that the diaphragm is replaced by a more rigid diaphragm, which has nearly the same mass, and that the new suspension has half the damping of the off-the-shelf speaker. The response for this system is also shown in FIG. 6. The results demonstrate that by reducing the effective stiffness of the system (due to the contributions of the air spring and the support apparatus), the resonance frequency is lowered and the response does not roll-off until a much lower frequency.

Figure 7:
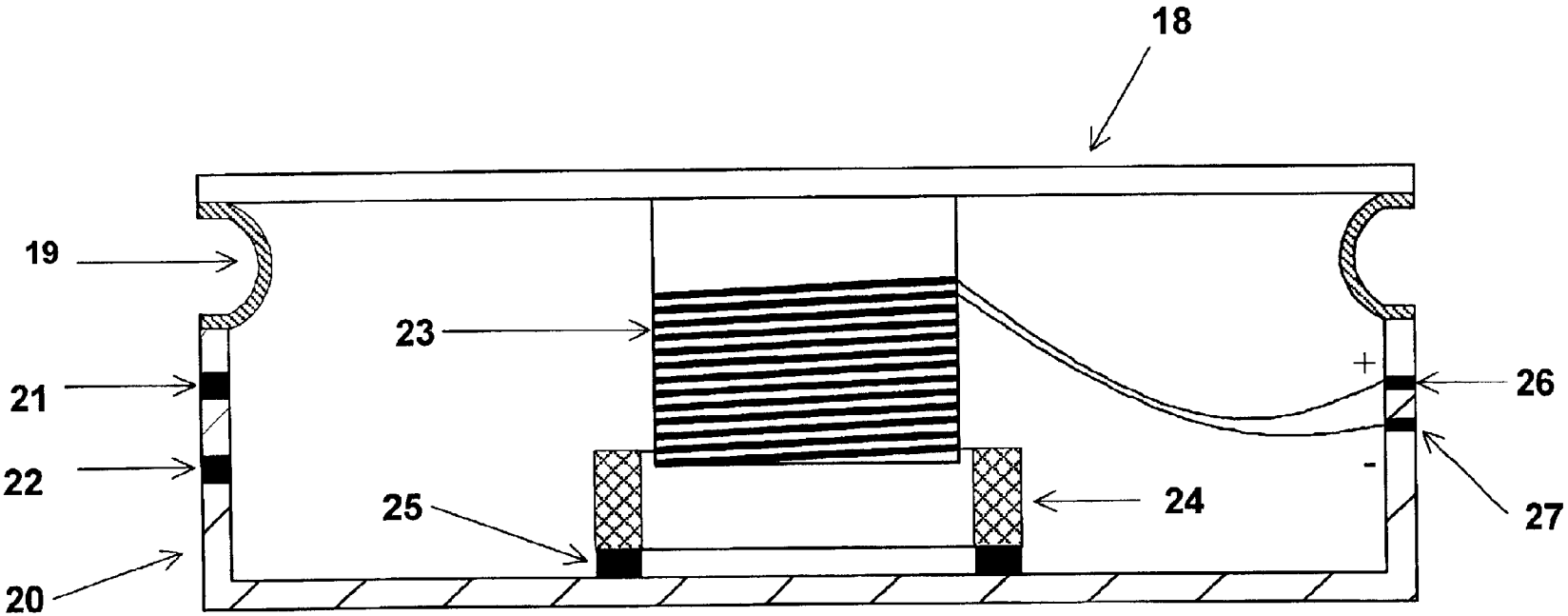
FIG. 7 is a schematic diagram of the preferred embodiment of the invention.

A schematic diagram of the preferred embodiment of the invention is presented in FIG. 7. The diaphragm 18 is attached to the support ring apparatus 19, which is then attached to the enclosure 20. The diaphragm must be constructed from a rigid material, such as a metal or composite, which will not collapse under the stress created by the partial vacuum. Here, a curved support ring extends around the circumference of the enclosure. The enclosure can be fabricated from polymers, composites, or metals, as long as it can withstand the stress from the pressure differential. The material used for construction must be non-porous in order to support a vacuum.

Figure 8:
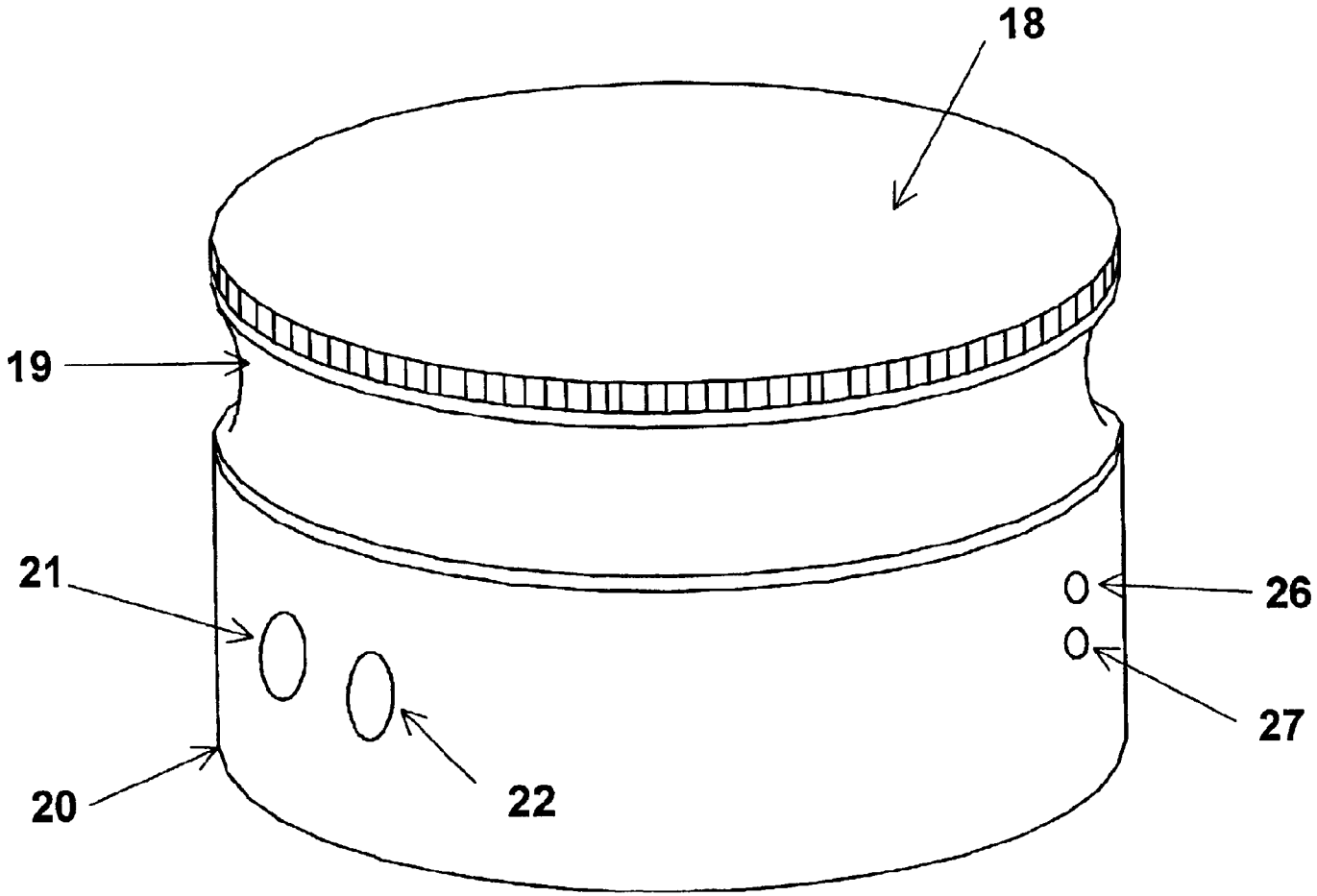
FIG. 8 is an external view of the integrated device.

Air is removed from the enclosure 20 through the evacuation value 21 until the desired internal pressure is achieved. As air is removed from the enclosure, the support ring 19 buckles as a result of the distributed force acting on the diaphragm 18. This allows the diaphragm and the voice coil 23 to descend to their operating position, such that the voice coil is positioned within the permanent magnet 24, which is mounted on a fixed base 25. An electric current is induced through the voice coil by applying a voltage across the input terminals 26 and 27. When the air is evacuated and the voice coil has been lowered into the magnetic field, the flow of current through the voice coil creates a force on the diaphragm, which causes it to move and radiate sound. An external view of the integrated structure is presented in FIG. 8. Air can be allowed to re-enter the enclosure through the release valve 22. Depending on the properties of the support apparatus and the designed amount of deflection, it may be necessary to incorporate vertical slits or perforations in the support ring 19 to allow proper deflection. This would require application of a sealant over these slits in order to maintain the interior vacuum.

Figure 9:
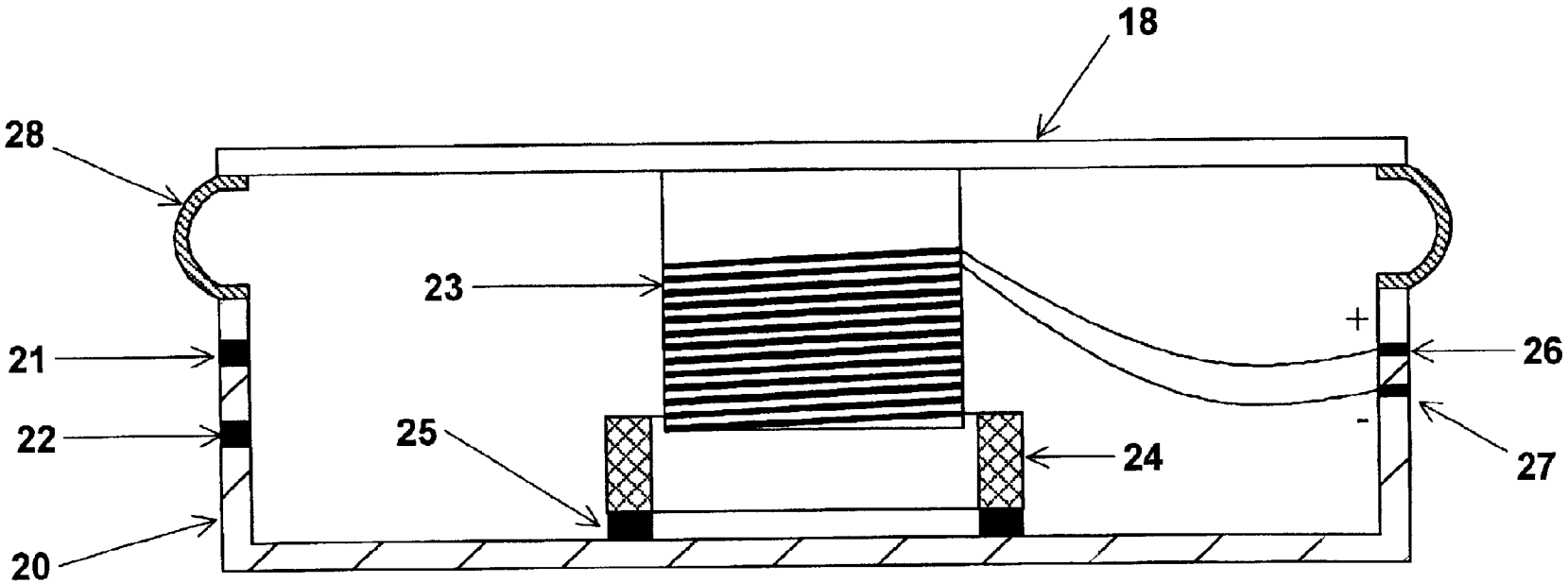
FIG. 9 is a schematic diagram of an embodiment of the invention using an outward deflecting support apparatus.

An alternate embodiment of this invention is presented in FIG. 9. Here, the support ring apparatus 28 is designed to buckle to the outside of the container. This is important from a design standpoint, since the effective stiffness is dependent upon the support deflection, which is dependent upon the bending moments produced on the support ring. By orientating the ring in this fashion, the distributed pressure forces acting on the ring will yield different deflection and stiffness characteristics than in the previous embodiment (Sechler, Ernest E., *Elasticity in Engineering*, John Wiley and Sons, New York, 1952). This can be used as a design parameter to achieve the desired actuator performance. Slits or perforations may be required in order to allow proper deflection.

Figure 10:
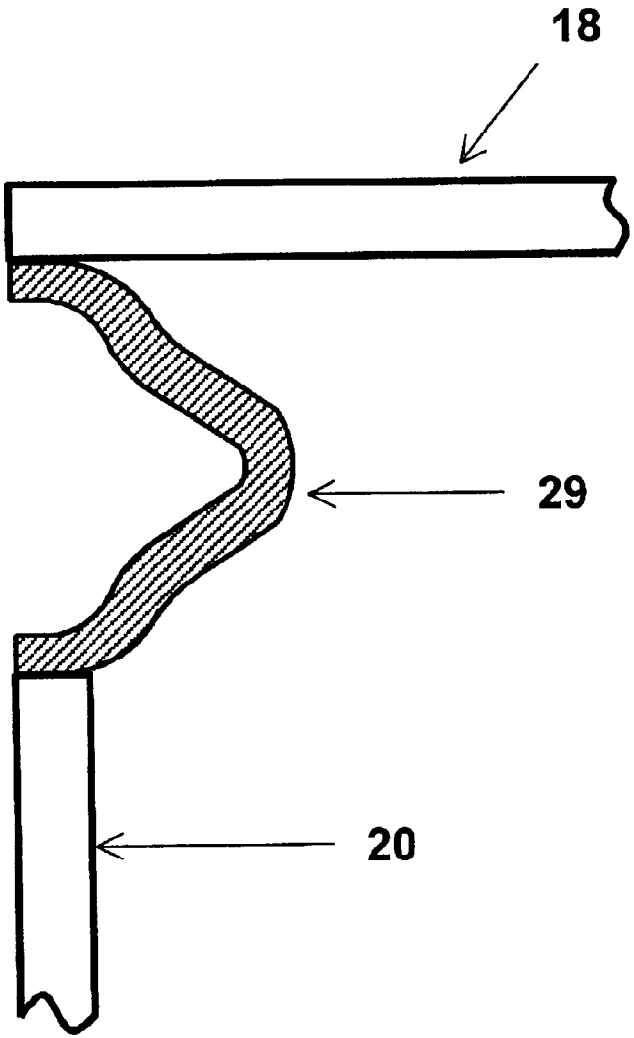
FIG. 10 illustrates an alternate support apparatus.

Another embodiment of the support apparatus is presented in FIG. 10. Here, a more complex shaped support apparatus 29 is used to attach the diaphragm to the enclosure. This alters the stiffness and deflection characteristics, and can be used as a design parameter to achieve the desired actuator performance.

Figure 11:
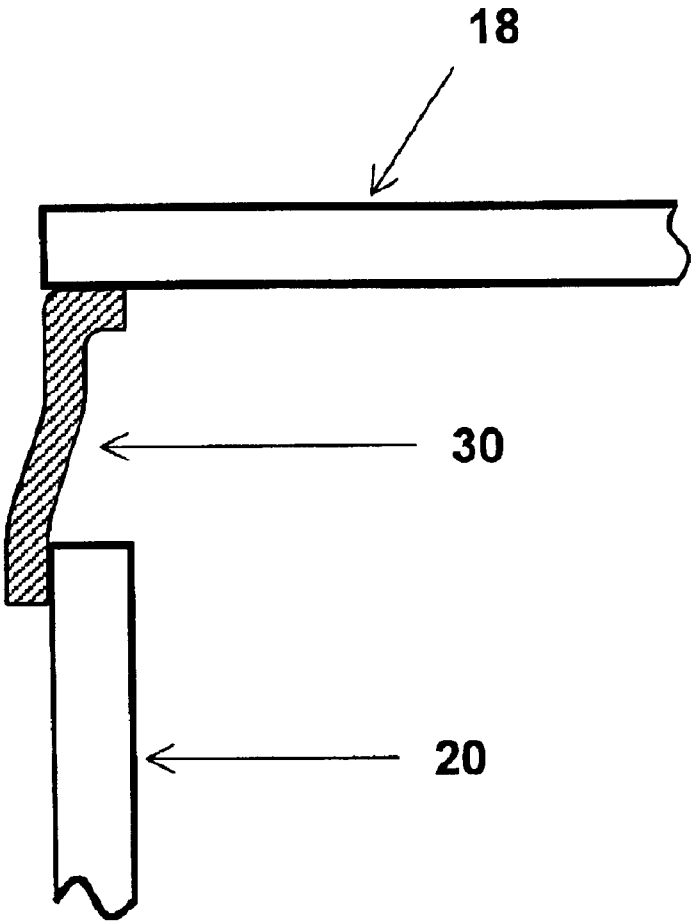
FIG. 11 illustrates a second alternate support apparatus.

Another embodiment of the support apparatus is presented in FIG. 11. Here, the support ring 30 is attached to the underside of the diaphragm and to the outside edge of the enclosure.

Figure 12:
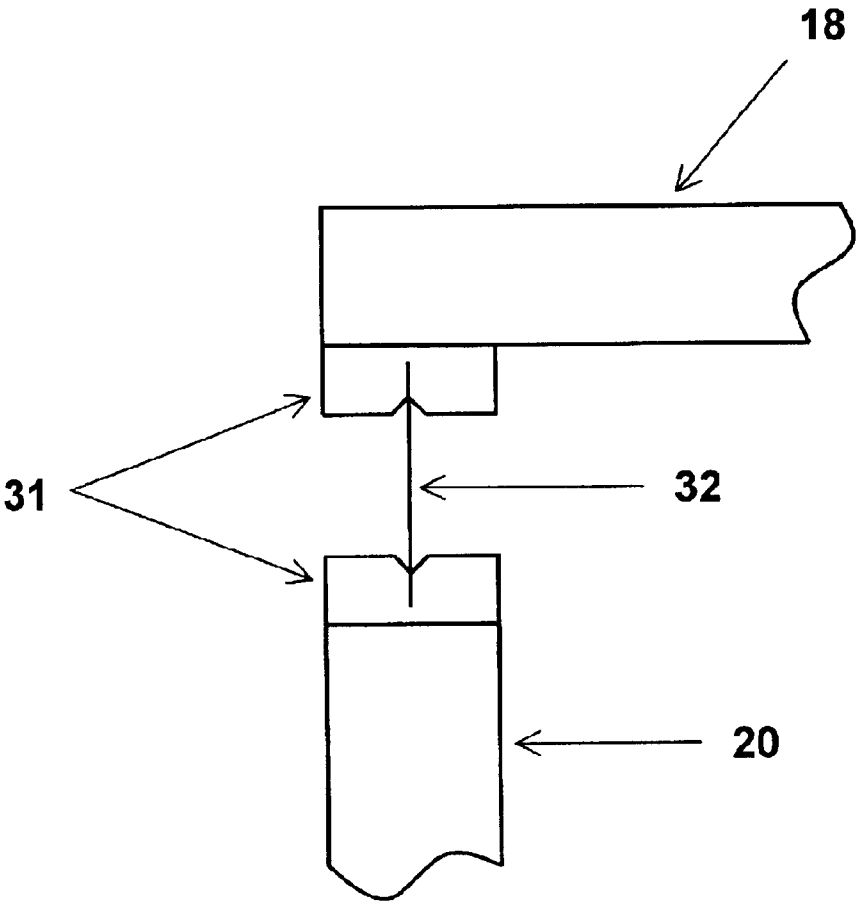
FIG. 12 illustrates a third alternate support apparatus.

Another embodiment of the support apparatus is presented in FIG. 12. Here, two grooved receptacles 31 are used, one attached to the diaphragm 18 and the second to the enclosure 20. A vertical support member 32 is inserted into the receptacles. As the enclosure is evacuated, the vertical member will buckle inwardly. This has the advantage of not requiring a curved support ring. Slits or perforations may be required in order to allow proper deflection.

Figure 13:
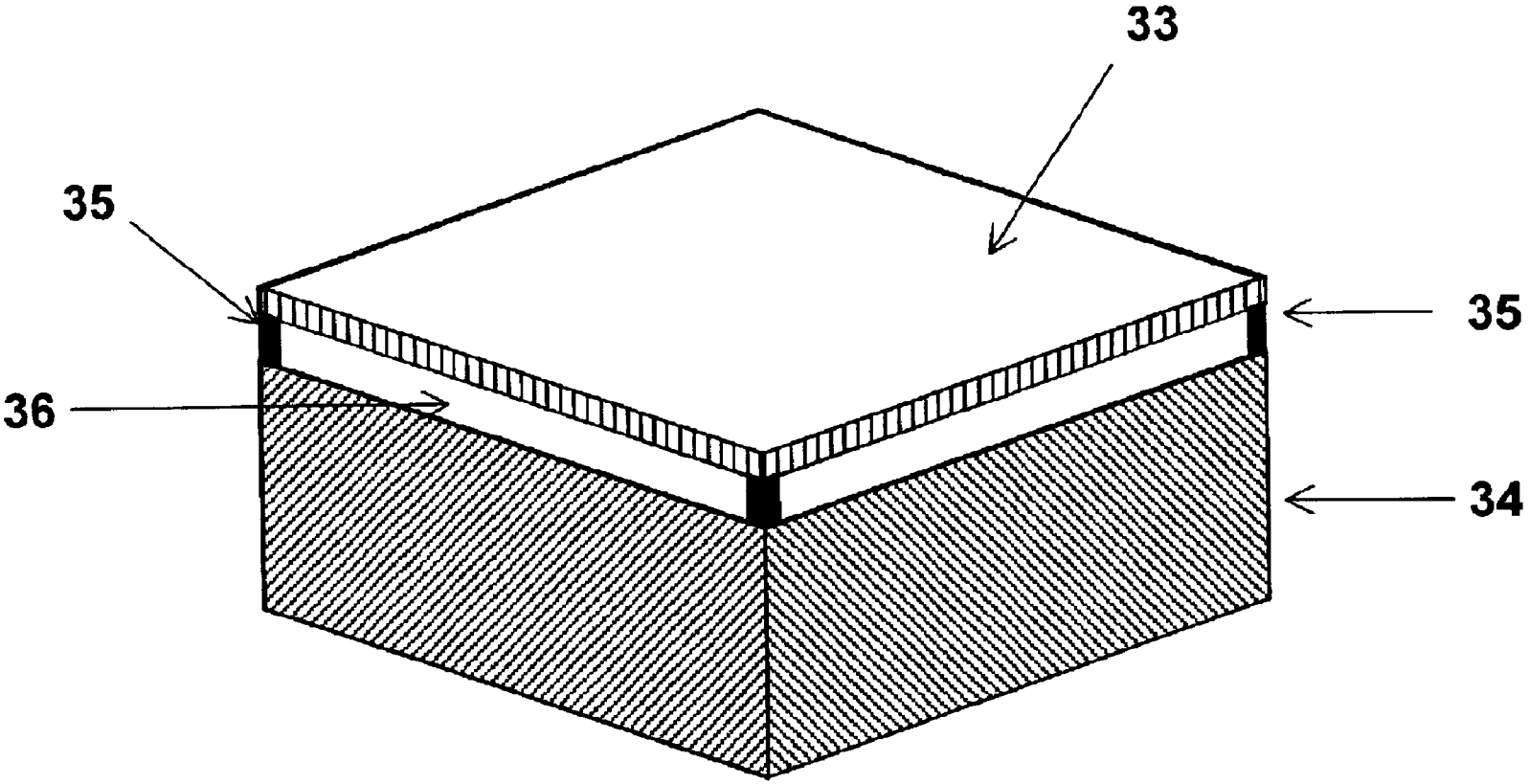
FIG. 13 is an external view of an embodiment of the invention using a rectangular enclosure and a rectangular diaphragm.

Another embodiment of this invention is presented in FIG. 13. A rectangular diaphragm 33 and a rectangular enclosure 34 are connected by collapsible supports 36. The edges (corners) of the supports are sealed with a flexible material 35 that is able to maintain the internal vacuum under deflection. Since the perimeter is non-circular, the support apparatus 36 will not require slits or perforations.

Figure 14:
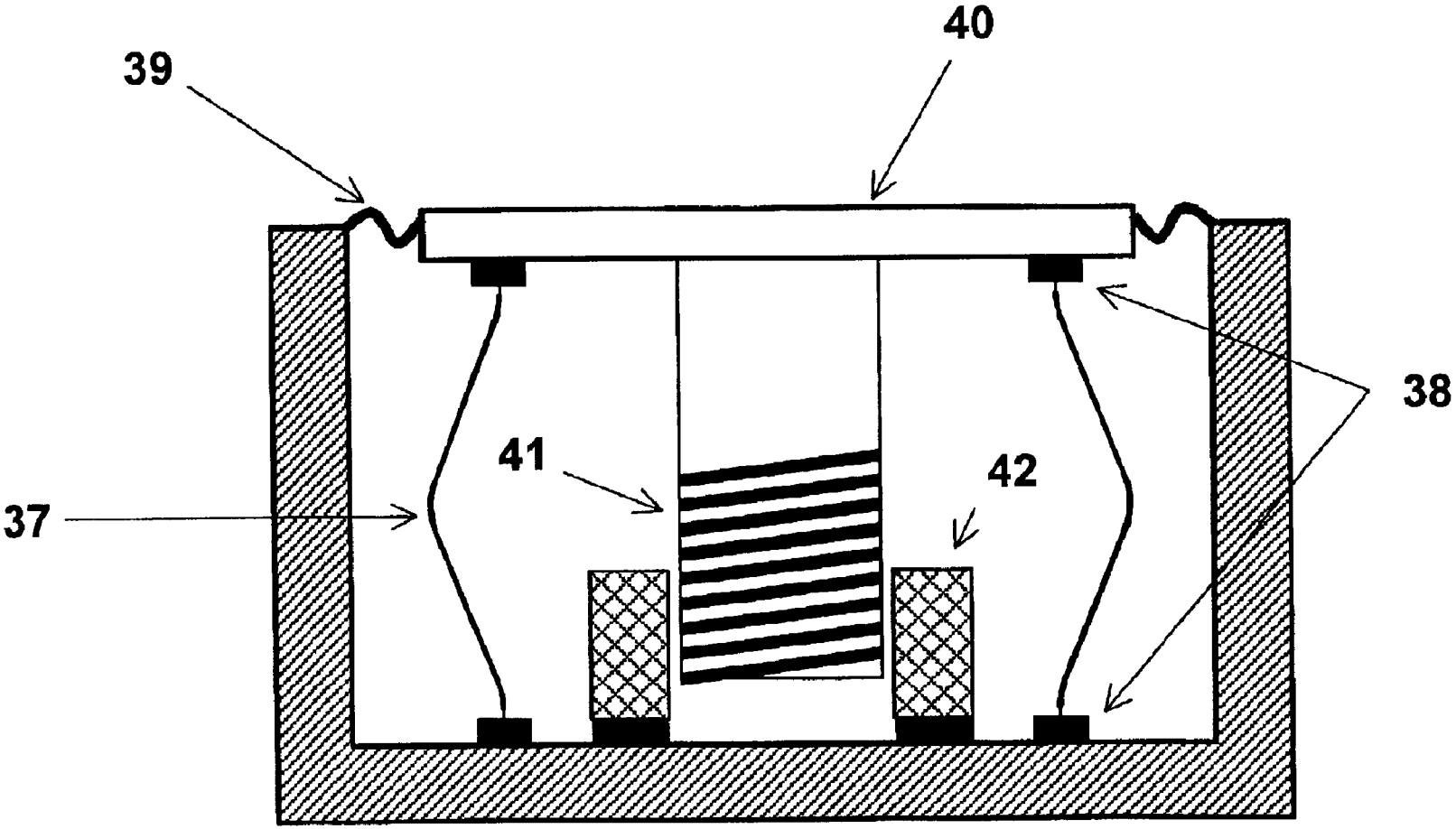
FIG. 14 is a schematic diagram of an embodiment of the invention using multiple buckling beams attached to the diaphragm.

Another embodiment of this invention is presented in FIG. 14. Here, multiple buckling support beams 37 are directly attached to the underside of the diaphragm 40 using the mounting attachments 38. A semi-rigid surround 39 connects the diaphragm 40 to the enclosure. As the chamber is evacuated, the diaphragm 40 and coil apparatus 41 translate downward towards the operating point so that the coil is between the magnets 42 during operation.

Figure 15:
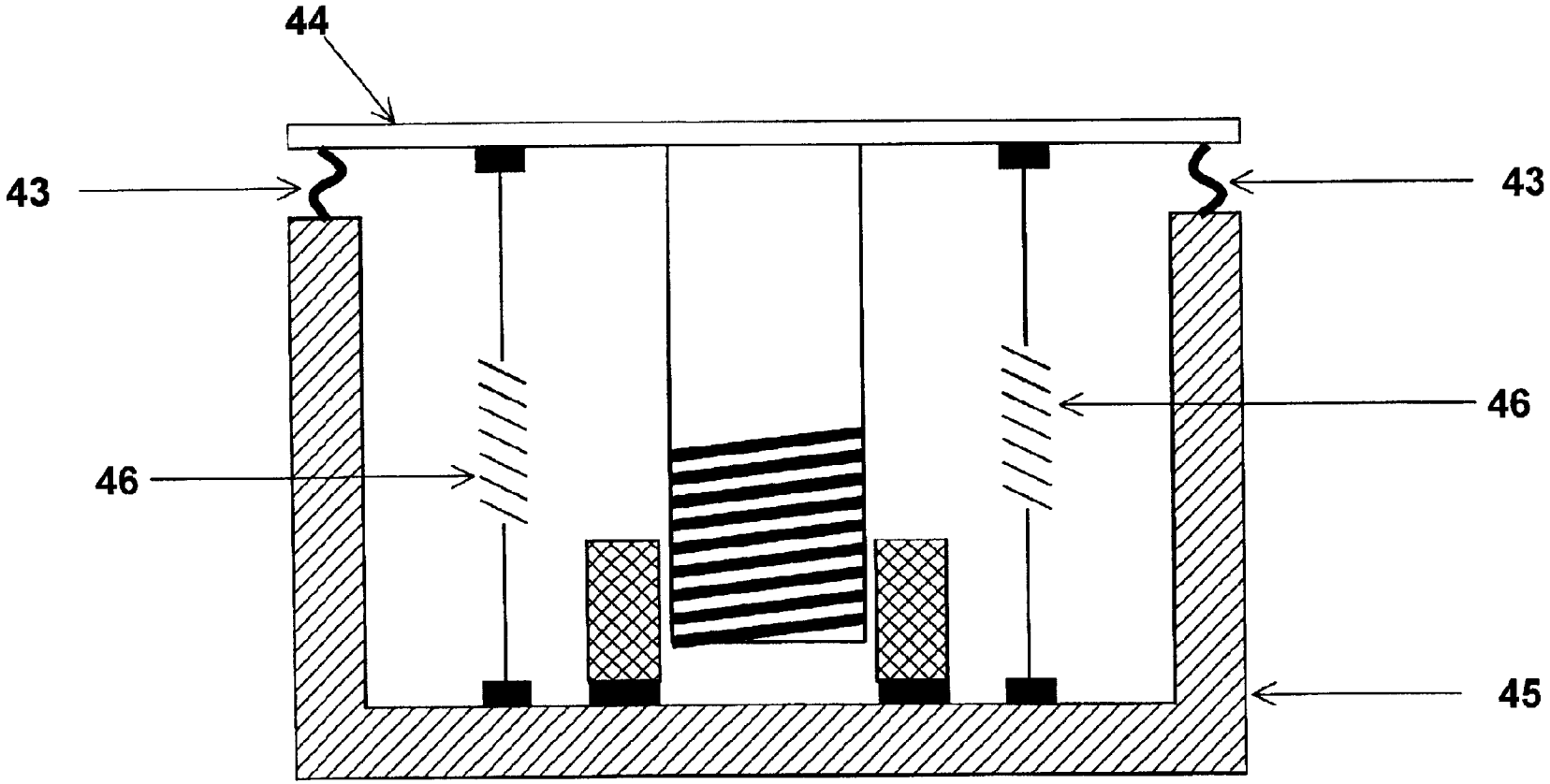
FIG. 15 is a schematic diagram of an embodiment of the invention where a load bearing non-linear support member attached to the diaphragm is contained within the enclosure.

Another embodiment of this invention is presented in FIG. 15. In this embodiment, a flexible member 43 connects the diaphragm 44 to the mounting enclosure 45, which is not a load bearing member, but instead facilitates proper deflection while maintaining the pressure differential. A non-linear suspension 46 connects the diaphragm to the enclosure and supports the pressure loading.

Figure 16:
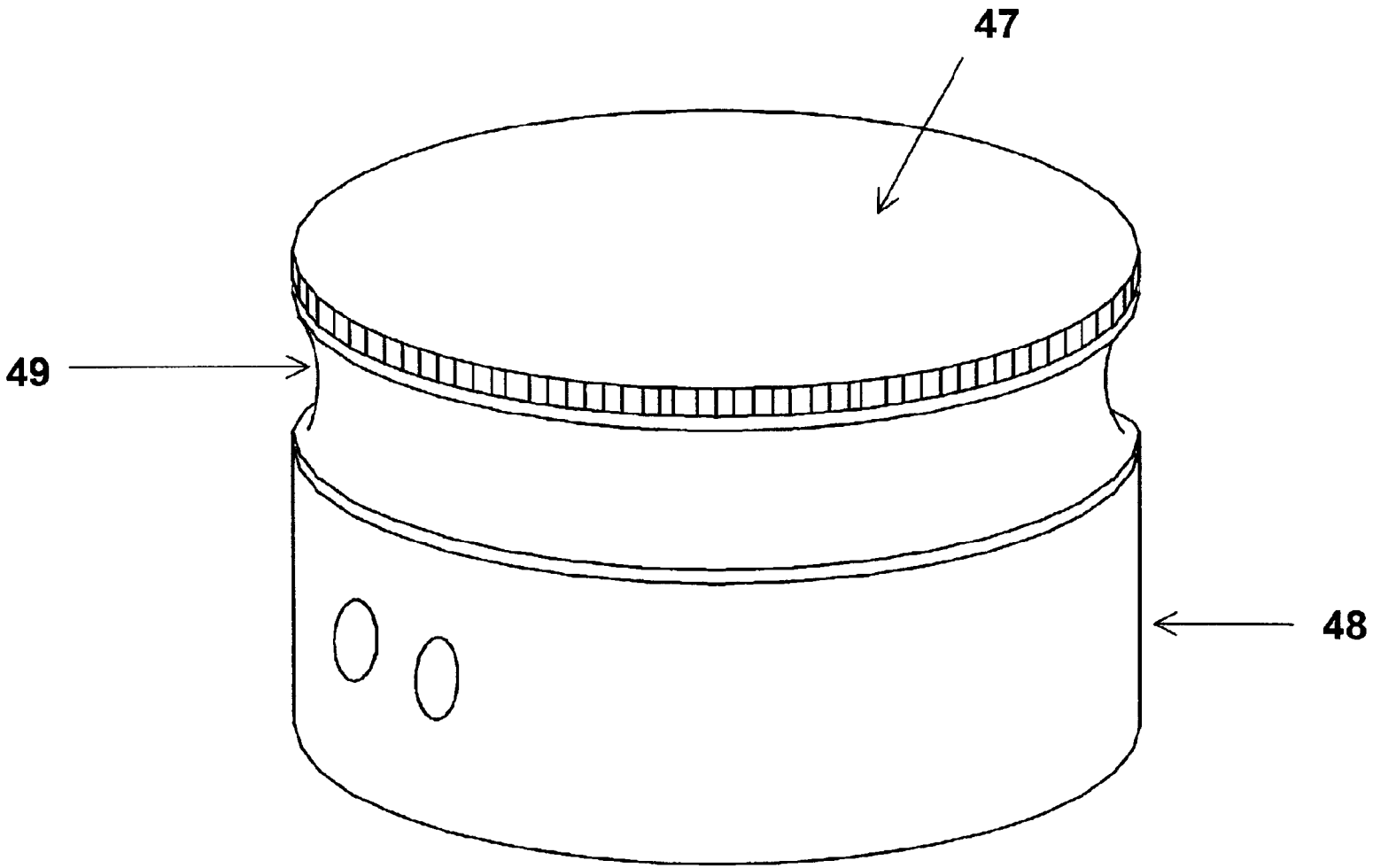
FIG. 16 shows an external view of an embodiment of the invention where the device is used as a passive acoustic attenuator.

Another embodiment of this invention is presented in FIG. 16. In this embodiment, no moving-coil is used. This removes the necessity of the magnets and the terminal inputs. This device is not intended to be used as a loudspeaker as in the prior embodiments, but rather as a passive acoustic attenuator. The diaphragm 47 is mounted on the enclosure 48 using the collapsible support apparatus 49, and the enclosure is evacuated. Alternatively, a non-linear support apparatus may be placed inside the enclosure, and the support apparatus 49 may be replaced by a flexible member, as described in the previous embodiment shown in FIG. 15. Since the resonance frequency of the diaphragm and suspension structure can be designed to be very low (on the order of a few Hertz), the resonance frequency of the device can be set to correspond to the frequency of acoustic modes in a room or other enclosure (such as a launch vehicle). The damping of the suspension can be adjusted using a variety of methods, such as visco-elastic treatments. Incident acoustic pressure waves cause motion of the diaphragm, which is damped by the suspension. By this mechanism, acoustic energy is dissipated.

We claim:

1. A passive suspension system having an extremely low natural frequency, comprising:

a semi-rigid diaphragm attached by a passive buckling support member to a sealable enclosure;

the enclosure being substantially evacuated of air to create a pressure differential across the diaphragm;

the diaphragm being capable of a deflection; and the support member having a non-linear stiffness that decreases as the deflection increases.

2. The passive suspension system defined in claim 1 wherein the support member is capable of supporting the large loads associated with the pressure differential across the diaphragm while simultaneously exhibiting a low stiffness on the order of conventional loudspeaker suspension systems.

3. The passive suspension system defined in claim 1 wherein the support member also sealably attaches the diaphragm to the enclosure.

4. The passive suspension system defined in claim 3 wherein:

the enclosure includes an inside and an outside; and the support member buckles towards the inside.

5. The passive suspension system defined in claim 3 wherein:

the enclosure includes an Inside and an outside; and the support member buckles towards the outside.

6. The suspension system of claim 1 wherein:

the support member is a plurality of buckling beams attached to the diaphragm; and a semi-rigid surround sealably attaches the diaphragm to the enclosure.

7. A passive suspension apparatus for suspending a semi-rigid diaphragm in a sealable enclosure, comprising:

a passive buckling support member attaching the diaphragm to the enclosure for suspending the diaphragm and allowing the diaphragm to move through a deflection relative to a datum;

the support member sealably connecting the diaphragm to the enclosure; and the support member having a stiffness that decreases non-linearly as the deflection increases.

8. The passive suspension apparatus as defined in claim 7 further comprising the enclosure being substantially evacuated of air to create a pressure differential across the diaphragm.

9. The passive suspension apparatus as defined in claim 7 further comprising a moving coil acoustic actuator contained within the enclosure and attached to the diaphragm for deflecting the diaphragm.

10. A passive suspension apparatus for suspending a semi-rigid diaphragm in a sealable enclosure, comprising:

a passive buckling support member attaching the diaphragm to the enclosure for suspending the diaphragm and allowing the diaphragm to move through a deflection relative to a datum;

the support member having a stiffness that decreases non-linearly as the deflection increases; and the enclosure being substantially evacuated of air to create a pressure differential across the diaphragm.

11. The passive suspension apparatus as defined in claim 10 further comprising a semi-rigid surround sealably connecting the diaphragm to the enclosure.

12. The passive suspension apparatus as defined in claim 11 further comprising a moving coil acoustic actuator contained within the enclosure and attached to the diaphragm for deflecting the diaphragm.

* * * * *